US006295705B1

(12) United States Patent
Gersten

(10) Patent No.: US 6,295,705 B1
(45) Date of Patent: Oct. 2, 2001

(54) BURIAL URN FOR CREMATED REMAINS

(76) Inventor: Daniel J. Gersten, 29636 Quail Run Dr., Agoura Hills, CA (US) 91301

( * ) Notice: Subject to any disclaimer, the term of this patent is extended or adjusted under 35 U.S.C. 154(b) by 0 days.

(21) Appl. No.: 09/415,710

(22) Filed: Oct. 12, 1999

(51) Int. Cl.[7] ..... A61G 17/00
(52) U.S. Cl. ..... 27/1; 220/4.27
(58) Field of Search ..... 27/1, 35; 220/4.27, 220/23.6; 206/508; D99/5, 8

(56) References Cited

U.S. PATENT DOCUMENTS

| | | | |
|---|---|---|---|
| D. 85,087 | | 8/1931 | Clarke . |
| D. 213,777 | | 4/1969 | Chandler et al. . |
| D. 214,894 | | 8/1969 | Chandler et al. . |
| D. 237,850 | | 12/1975 | Booty . |
| D. 268,623 | | 4/1983 | Dercks et al. . |
| D. 272,577 | | 2/1984 | Dercks et al. . |
| 2,663,450 | * | 12/1953 | Bourcart . |
| 4,977,652 | * | 12/1990 | Graham . |
| 5,401,200 | * | 3/1995 | Ellis ..... 220/4.27 |
| 5,409,128 | * | 4/1995 | Mitchell . |
| 5,625,933 | * | 5/1997 | Neuberger et al. . |
| 5,815,897 | * | 10/1998 | Longstreth . |
| 5,832,575 | | 11/1998 | Sturino . |
| 5,887,740 | * | 3/1999 | Hong . |
| 6,023,822 | * | 2/2000 | Luebke . |

* cited by examiner

*Primary Examiner*—B. Dayoan
*Assistant Examiner*—William L. Miller
(74) *Attorney, Agent, or Firm*—Jack C. Munro

(57) ABSTRACT

A burial urn for cremated remains which utilizes a primary receptacle which has an internal chamber. Both the top surface and bottom surface of the primary receptacle have a female connector. The female connector of the top surface is to connect to a lid which includes a male connector which is to matingly connect with the female connector formed within the top surface. The female connector of the bottom surface is to connect with a male connector formed within a secondary receptacle or the male connector of an enlarged base. The sidewall of the primary receptacle has a plurality of memorial plaque mounting areas.

3 Claims, 2 Drawing Sheets

BURIAL URN FOR CREMATED REMAINS

BACKGROUND OF THE INVENTION

1) Field of the Invention

The field of this invention relates to receptacles and more particularly to a burial urn which is adapted to contain the cremated ashes of one or more family members.

2) Description of the Prior Art

Cremation of the mortal remains of living creatures, such as humans and pets, has become increasingly popular. The popularity of cremation is almost assuredly due to the fact that it is less expensive than being interred in the ground, and it may avoid storage charges if the remains are located within an individual's residence if not stored at some exterior location, such as in a mortuary. The end product of the cremation process, after removal of non-combustible materials and grinding, is a small volume of very finely ground ash.

Disposal of this ash has taken many forms. One form would be to dispose of the ash into a sea or on land in a particular location. In such an instance, there is no need for a burial urn. However, some people choose to retain the cremated remains as constituting a memory of the loved one that has been lost. Typically, burial urns take the form of a vase or a similar type of container where the cremated remains of the lost loved one are to be placed. In some families where there have been a plurality of lost loved ones, this would mean that there is a plurality of separate containers that are stored somewhere within the individual's residence or, if it is stored at an exterior location, within a crematorium or cemetery.

SUMMARY OF THE INVENTION

The primary objective of the present invention is to construct a burial urn which is designed to be utilized not only for a single individual but actually a plurality of individuals.

Another objective of the present invention is to construct a burial urn which is attractive in appearance and can be located within a person's residence.

Another objective of the present invention is to construct a receptacle for the cremated remains of loved ones of a single family which allows the living family members to have the deceased family members with the living family members throughout the years regardless of where the living family members move and reside.

Another objective of the present invention is to construct a burial urn that is designed to be both a receptacle for the combined cremated remains of loved ones as well as a log of who they were relative to the family, much like the family plot of yore.

Another objective of the present invention is to construct a burial urn which has inscribed thereon a brief record of each individual that is contained within the urn.

Another objective of the present invention is to construct a burial urn which is constructed in modular fashion which will allow the additions of different modules to be added as time goes on.

The primary burial receptacle of the present invention includes a sidewall which is preferably made in a polygonal shape, such as a hexagon. Access into the hollow internal chamber of the urn is accomplished through an opening formed in the top surface of the urn. A lid, which includes a male connector, is to matingly connect with a first female connector of the opening so as to close the internal chamber when not adding of cremated remains within the urn. The bottom surface of the urn includes a second female connector which is to be connected to a male connector of a secondary burial receptacle or a mounting base. The secondary burial receptacle may also be of a hexagonal configuration. The secondary burial receptacle will also include a female connector in its bottom surface.

DETAILED DESCRIPTION OF THE PREFERRED EMBODIMENT

Figure 1:
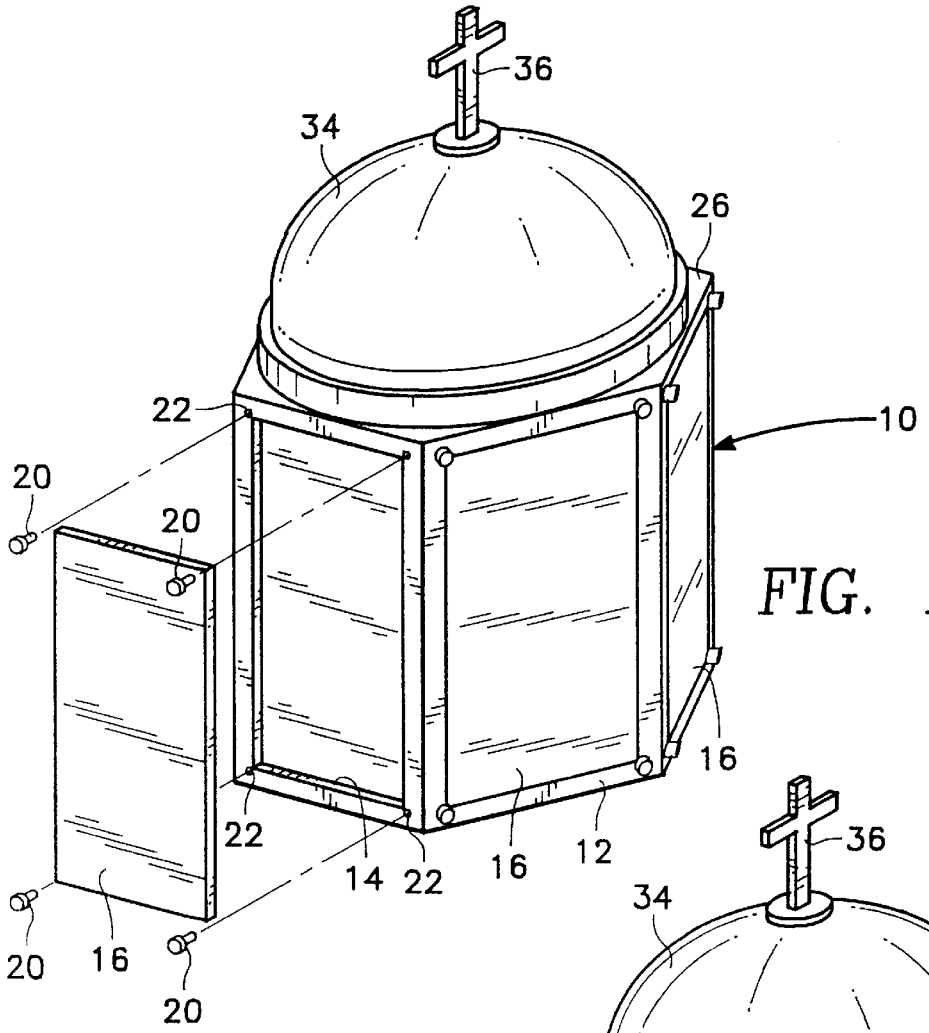
FIG. 1 is an isometric view of the burial urn of the present invention which has a primary receptacle connected to a dome shaped lid.
Figure 2:
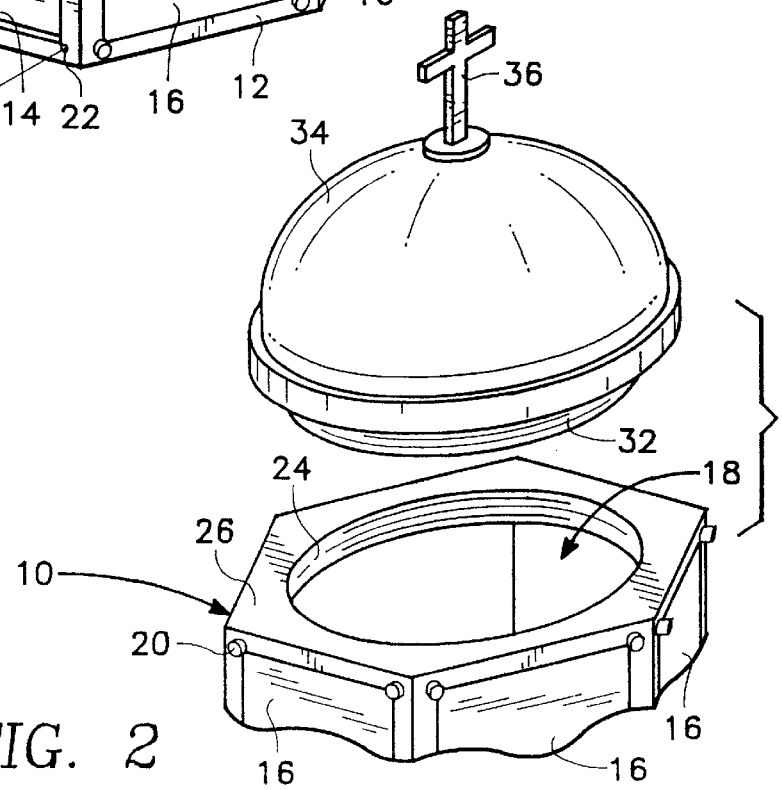
FIG. 2 is a perspective view showing the dome shaped lid removed from the primary receptacle.

It used to be that family that grew together was buried together. You can walk into older cemeteries and see family plots which are places where generation after generation of a family are buried in close proximity to one another. You can learn a significant amount of information just be reading the tombstones like whom married whom, whose children were whose, whether someone dies at a relatively old age or young age, and so forth. You can sense the "essence" of a family and impact they may have had on each other and/or the town or community in which the family lived.

For most mobile Americans, that is no longer the situation. Families are disbursed throughout the country. Parents move to retirement communities. Children move off to start their own lives in some remote location. Parents get divorced and remarried. Graves of our ancestors, our parents, and our children are no located at one place. The concept of the family plot is no longer viable.

However, the need or the desire of the family has been just as great. Genealogy societies are prospering. On-line services to help people trace their ancestry are heavily visited and used. Stories concerning the desire to find one's roots appear on the cover of national magazines. One way in which the family plot concept can be captured in today's world is by means of a memorial receptacle or urn which is designed to receive and hold the ashes of a plurality of family members.

Referring particularly to the drawings, there is shown a primary receptacle 10 which is constructed of a metallic material and a sidewall 12 which is formed polygonal in shape with the preferable shape being that of a hexagon. The hexagonal shape will divide the side wall 12 into six of number of separate panels each of which includes a rectangularly shaped recess 14. Each recess 14 is adapted to receive a plaque 16. Each plaque 16 will be located within the recess 14 in a close fitting manner. Each plaque 16 is to have inscribed on its outer surface appropriate indicia such as information about the particular individuals whose ashes are contained and have been deposited within the internal chamber 18 of the primary receptacle 10. Typically, each panel 18 will have inscribed thereon the year of birth, year of death, possibly a picture of the individual and other desirable information, such as possibly an epitaph. In order to fixedly secure each of the plaques 16 in position, located at each corner of the plaque 16 is a screw type of fastener 20. Each fastener 20 is to be securely fastened into a screw threaded hole 22 formed within the primary receptacle 10.

Access into the internal compartment 18 is achieved through a female threaded hole 24 which is formed within the top surface 26 of the primary receptacle 10. Formed within the bottom surface 28 of the primary receptacle 10 is a threaded recess 30. The threaded recess 30 and the female threaded hole 24 constitute female connectors.

After the ashes of an individual are deposited through the threaded hole 24 and are located within the internal chamber 18, the female threaded hole 24 is to be closed by a male threaded connector 32 being engaged in a threadably secured relationship with the female threaded hole 24. The male threaded connector 32 is integrally mounted on a dome shaped lid 34. The dome shape lid 34 may include some type of ornamentation, such as a cross 36. It is to be understood that it is within the scope of this invention that numerous configuration of lids 34 can be utilized either with ornamentation or without ornamentation. One typical lid would be merely a flat, hexagonal shaped lid which is basically similar to the overall exterior configuration shape of the primary receptacle 10. It is to be understood that the dome shape lid 34 is to be threadingly removed from the primary receptacle 10 in order to permit the entry of additional ashes within the internal chamber 18.

The bottom surface 28 may be merely placed on a supporting surface 38 if no more than six in number of the plaques 16 is required. However, if there is a need for a greater number than six, the threaded recess 30 may be threadingly connected with threaded male connector 40 which is formed within the top surface of a secondary receptacle 44. The secondary receptacle 44 has an internal chamber 46. Access into the internal chamber 46 is accomplished through access opening 48 formed through the male connector 40. It is to be understood that ashes are to be deposited and stored within the internal chamber 46.

Figure 3:
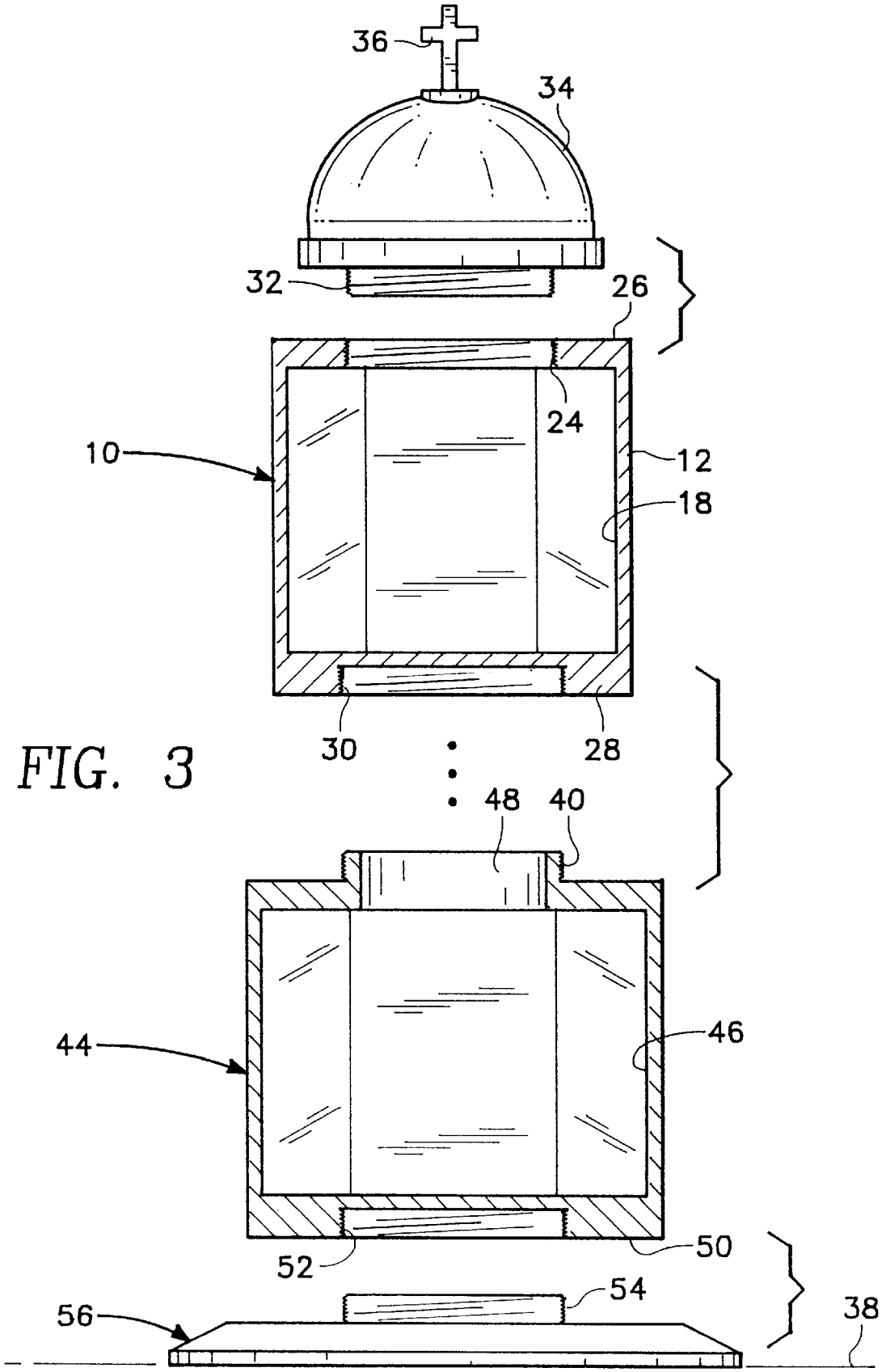
FIG. 3 is an exploded longitudinal cross-sectional view showing the primary receptacle being connected with the secondary receptacle which in turn is connected with a base and with a dome shaped lid being connected to the primary receptacle.

The exterior configuration of the secondary receptacle 44 may be any particular desired configuration, such as round or can be hexagonal as was also the primary receptacle 10. Also, it may be desirable, as shown in FIG. 3 of the drawings, that the size of the secondary receptacle 44 be somewhat bigger than the primary receptacle 10. In essence, the connection of the primary receptacle 10 to the secondary receptacle 44 establishes a modular type of memorial burial urn with the modules to be added as such are needed. The bottom surface 50 of the secondary receptacle 44 is to include a recess 52 which is formed into a female connector. This recess 52 is to be able to be connected to a male connector 44 of a supporting base 56. The bottom surface 50 could merely rest on the supporting surface 38 or could be connected to the supporting base 56 which is in turn placed on the supporting surface 38.

It is envisioned that each of the panels in the primary receptacle might be in the range of two and one-half inches wide and four to five inches in height. Both the primary receptacle 10 and the secondary receptacle 44 could be made of difference materials such as wood, stone, ceramic, metal and also plastic. Although it is envisioned that the plaque 16 will normally be made of metal which facilitates engraving thereon, it is considered to be within the scope of this invention that other material could be used such as plastic. One of the plaques 16 could be what is referred to as Title Plaque which gives the general overall family information. Each remaining plaques 16 on the primary receptacle 10 and also on the secondary receptacle 44 would be pertinent to a particular individual.

What is claimed is:

1. A burial urn for cremated remains comprising:

a primary receptacle having an internal compartment, said primary receptacle having a first top surface and a first bottom surface interconnected by a sidewall, said first top surface being substantially parallel to said first bottom surface;

a first female connector formed within said first top surface;

a lid having a first male connector, said first male connector to lockingly engage in a removable manner with said first female connector;

a second female connector formed within said first bottom surface, whereby said first bottom surface can either be placed on a supporting surface or connected to a secondary receptacle or an enlarged base by said second female connector; and said sidewall in transverse cross-section being hexagonal in shape whereby said sidewall forms a plurality of separate planar surfaces with each said planar surface being adapted to connect with a separate memorial plaque.

2. The burial urn as defined in claim 1 including:

said secondary receptacle, said secondary receptacle having a second top surface and a second bottom surface, said second top surface having a second male connector, said second bottom surface having a third female connector, whereby said second male connector being adapted to be connected to said second female connector.

3. The burial urn as defined in claim 2 including:

said enlarged base, said enlarged base having a third male connector, said third male connector adapted to connect with either said second or third female connector.

* * * * *